United States Patent [19]

Hayashi

[11] Patent Number: 4,461,247

[45] Date of Patent: Jul. 24, 1984

[54] CYLINDER BLOCK

[75] Inventor: Yoshimasa Hayashi, Kamakura, Japan

[73] Assignee: Nissan Motor Company, Ltd., Yokohama, Japan

[21] Appl. No.: 419,698

[22] Filed: Sep. 20, 1982

[30] Foreign Application Priority Data

Sep. 21, 1981 [JP] Japan ..... 56-149204

[51] Int. Cl.[3] ..... F01P 3/02

[52] U.S. Cl. ..... 123/41.79; 123/195 R

[58] Field of Search ..... 123/41.72, 41.79, 41.74, 123/195 R; 92/146

[56] References Cited

U.S. PATENT DOCUMENTS

| | | | |
|---|---|---|---|
| 1,926,684 | 9/1933 | Miller | 123/41.79 |
| 3,173,407 | 3/1965 | Sampietro et al. | 123/195 R |
| 3,481,316 | 12/1969 | Olson et al. | 123/195 R |
| 4,305,348 | 12/1981 | Martin | 123/41.72 |

FOREIGN PATENT DOCUMENTS

| | | | |
|---|---|---|---|
| 657900 | 3/1938 | Fed. Rep. of Germany . | |
| 1955383 | 5/1971 | Fed. Rep. of Germany . | |
| 2539478 | 3/1977 | Fed. Rep. of Germany | 123/41.72 |
| 2055422 | 3/1981 | United Kingdom . | |

OTHER PUBLICATIONS

AUTOMOTIVE ENGINEERING, "Diesel Noise Reduction: A Study", vol. 90, No. 6, pp. 70–74 (Jun. 1982).

*Primary Examiner*—William A. Cuchlinski, Jr.

*Attorney, Agent, or Firm*—Schwartz, Jeffery, Schwaab, Mack, Blumenthal & Koch

[57] ABSTRACT

A cylinder block comprises an upper block deck disposed along whole the periphery of a cylinder-barrel section to securely connect the cylinder-barrel section with a water jacket outer wall section. The upper block deck is located below the top of the cylinder block and so positioned that its center lies at the level of an uppermost part of the skirt section of a piston which is at a range from TDC to 30 degrees relative to TDC. Additionally, upper and lower water jackets are formed at the upper and lower sides of the upper block deck, and communicate with each other through water holes formed through the upper block deck. By virtue of the thus located upper block deck, the wall of the cylinder-barrel section is effectively prevented from vibration due to piston slap, thereby greatly reducing piston slap noise emitted from the cylinder block.

5 Claims, 4 Drawing Figures

CYLINDER BLOCK

BACKGROUND OF THE INVENTION

1. Field of the Invention

This invention relates to an improvement in a cylinder block of an automotive engine, and more particularly to an improved location of an upper block deck of the cylinder block in order to reduce engine noise.

2. Description of the Prior Art

In connection with an automotive engine employing a cylinder block of a so-called closed type wherein an upper block deck is located at the top part of the cylinder block, the upper block deck is separate from the location where piston slap occurs. Accordingly, the upper block deck does not contribute to suppressing the vibration of the cylinder wall due to piston slap, thereby emitting considerable piston slap noise which forms part of engine noise.

SUMMARY OF THE INVENTION

A cylinder block according to the present invention comprises an upper block deck disposed along the whole periphery of a cylinder-barrel section with a water jacket outer wall section. The upper block deck is located below the top of the cylinder block and so positioned that its center lies at the level of an uppermost part of a piston which is at a range from TDC to 30 degrees relative to TDC in crank angle. Additionally, upper and lower water jackets are formed at the upper and lower sides of the upper block deck, and they communicate with each other through holes formed through the upper block deck. By virtue of the thus located upper block deck, vibration of the cylinder-barrel section wall due to piston slap is effectively suppressed, thereby largely reducing piston slap noise emitted from an engine.

BRIEF DESCRIPTION OF THE DRAWINGS

The features and advantages of the cylinder block according to the present invention will be more clearly appreciated from the following description taken in conjunction with the accompanying drawings in which the same reference numerals designate the same parts and elements, and in which.

DETAILED DESCRIPTION OF THE INVENTION

Figure 1:
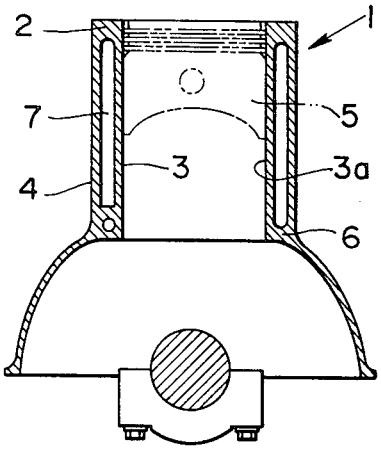
FIG.1 PRIOR ART
FIG. 1 is a vertical sectional view of a conventional cylinder block.
Figure 2:
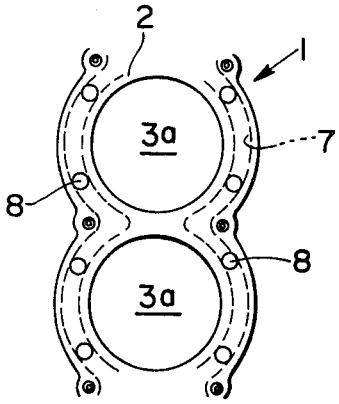
FIG.2 PRIOR ART
FIG. 2 is a fragmentary top view of the cylinder block of FIG. 1.

To facilitate understanding the present invention, a brief reference will be made to a conventional cylinder block 1 with reference to FIGS. 1 and 2. The conventional cylinder block 1 is of a so-called closed type wherein an upper block deck 2 is employed. A cylinder-barrel section 3 having a plurality of engine cylinders 3*a* is located inside of a water jacket outer wall 4. A piston 5 is movably disposed within each engine cylinder 3*a*. The cylinder-barrel section 4 is integral with the water jacket outer wall 4 through the upper block deck 2 and a lower block deck 6. A water jacket 7 through which engine coolant flows are formed among upper and lower block decks 2, 4, the cylinder barrel structure 3 and the water jacket outer wall 4.

The upper block deck 2 is located at the top of the cylinder block where a cylinder head (not shown) is to be secured, and formed to have a thickness, for example, of 9 mm, the top surface of the upper block deck being formed smooth by machining. Additionally, the upper block deck 2 is provided with a plurality of holes 8 through which the water jacket 7 and a water jacket formed in the cylinder head communicate with each other.

Now, as is well known, the direction of piston movement changes at top dead center, and accordingly there develops so-called piston slap noise which becomes a cause of engine noise. In this regard, the location at which the piston 5 strikes against the engine cylinder wall is at a level considerably lower than the upper block deck 2. Accordingly, the upper block deck 2 hardly contributes to preventing vibration of the cylinder-barrels 3*a* due to piston slap.

Figure 3:
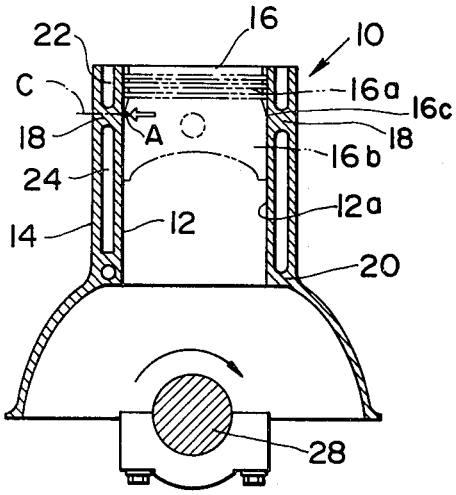
FIG. 3 is a vertical sectional view of a preferred embodiment of a cylinder block in accordance with the present invention.
Figure 4:
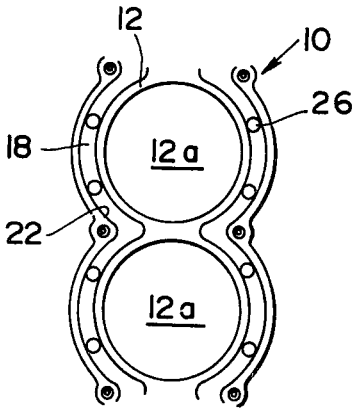
FIG. 4 is a fragmentary top view of the cylinder block of FIG. 3.

In view of the above description of the conventional cylinder block, reference is now made to FIGS. 3 and 4 wherein a preferred embodiment of a cylinder block of the present invention is illustrated by the reference numeral 10. The cylinder block 10 comprises a cylinder-barrel section 12 formed at the upper part of the cylinder block 10. The cylinder-barrel section 12 is located within a water jacket outer wall section 14 and formed with a plurality of engine cylinders 12*a* in each of which a piston 16 is movably disposed. An upper block deck 18 is located at a lower level relative to the top surface of the cylinder block 10 and disposed so as to surround the whole periphery of the cylinder-barrel section 12. The cylinder-barrel section 12 is integrally connected with the water jacket outer wall section 14 through the upper block deck 18 and a lower block deck 20 which is located at the lowermost part of the cylinder-barrel section 12. As shown, an upper water jacket 22 is formed at the upper side of the upper block deck 18, in which the upper water jacket 22 is opened upward to communicate with a water jacket formed in a cylinder head (not shown). Additionally, a lower water jacket 24 is formed between the upper block deck 18 and the lower block deck 20, and communicates with the upper water jacket 22 through water holes 26 formed through the upper block deck 18. Engine coolant will flow in these upper and lower water jackets 22, 24.

It is to be noted that the upper block deck 18 is positioned at a location corresponding to a place where piston slap generation is the most conspicuous. More specifically, the piston 16 of a conventional type is formed with a ring section 16*a* and a skirt section 16*b*. The ring section 16*a* carries piston rings and is slightly smaller in diameter than the skirt section 16*b*, and therefore it scarcely strikes against the inner wall surface of the cylinder 12*a*. The skirt section 16*b* is formed slightly tapered to prevent seizure, so that its lower part is slightly larger in diameter than its upper part. Accordingly, a clearance formed between the lower part of the piston skirt section 16*b* and the cylinder inner wall surface is smaller and therefore the movable amount of the piston skirt section lower part is smaller so that impact force thereof against the cylinder inner wall surface is lower. As a result, the largest vibration due to piston slap is generated by a piston shoulder section 16*c* located at an uppermost part of the piston skirt section 16*b* or at the border between the piston ring section 16*a* and the piston skirt section 16*b*, when the piston 16 is within a range from TDC (top dead center) to 30 degrees ATDC (after top dead center) in crankangle or the vicinity thereof. In this crankangle range, the horizontal component of a resultant force composed by a force due to combustion pressure and inertia force increases, and therefore the piston shoulder section 16*c* strongly strikes against the inner surface of the cylinder 12*a*. A point A in FIG. 3 indicates a striking point where the piston shoulder section 16*c* strongly strikes against the cylinder inner wall surface in the direction indicated by an arrow when a crankshaft 28 rotates in the direction of an arrow. In this regard, as shown, the upper block deck 18 is so located that its center C lies at the level of the point A or the piston shoulder 16*c* when the piston 16 is at TDC.

With the above cylinder block 10 provided with the thus located upper block deck 18, the deformation of the cylinder-barrel section 12 due to piston striking is suppressed by the rigidity of the upper block deck 18. This decreases the amplitude of vibration due to piston slap, thereby noticeably reducing piston slap noise emitted from the water jacket outer wall section 14 to the outside of the cylinder block 10. As discussed above, although the upper water jacket 22 is opened upward, the lower deck of the cylinder head is secured onto the cylinder block top so as to rigidly fix the top of the cylinder-barrel section 12 and the water jacket outer wall section 14. As a result, there rises no problem from view points of mechanical strength and vibration of the cylinder block top section. Additionally, the top surface of the cylinder block 10 is machined to obtain a smooth surface after casting as in the upper block deck of the cylinder block as shown in FIGS. 1 and 2, in which the surface area of the top of the cylinder block 10 considerably small as compared with in the conventional cylinder block, thereby facilitating the machining of the top surface of the cylinder block 10.

As a result of this lowering the location of the upper block deck 18, the upper part of the cylinder-barrel section 12 which is subjected to high temperature is in contact with engine coolant without being obstructed by the upper block deck, thereby obaining good engine cooling. In this connection, combustion within the cylinder 12*a* usually almost completes during piston descent movement of 15% of a piston stroke from TDC. In the cylinder block configuration in FIGS. 3 and 4, a combustion chamber formed above the crown of the thus descended piston is generally surrounded by the upper water jacket 22, and therefore engine cooling is effective as compared with the conventional cylinder block which is formed at its top with the upper block deck. This also prevents the strain of the cylinder-barrel section 12 due to non-uniform temperature distribution, and local overheating of the same.

While the location of the upper block deck 18 has been shown and described with reference to FIG. 3, it will be understood that the upper block deck 18 may be so located that its center C lies at the level of the shoulder section 16*c* of the piston 16 which is at a range from TDC to 30 degrees ATDC in crankangle, which is also effective to achieve the purpose of the present invention.

As will be appreciated from the above, the cylinder block according to the present invention is provided with the upper block deck which is located considerably below the top of the cylinder block, i.e., at the level of the shoulder section of the piston at a range from TDC to 30 degrees relative to TDC. Additionally, the upper and lower water jackets are formed on the upper and lower sides of the upper block deck, and they communicate with each other through the water holes formed through the upper block deck. As a result, the vibration of the cylinder-barrel section can be effectively suppressed, thereby greatly reducing piston slap noise emitted to the outside of the engine.

What is claimed is:

1. A cylinder block comprising:

a cylinder-barrel section;

a water jacket outer wall section disposed around said cylinder-barrel section, defining therebetween a water jacket;

an upper block deck disposed along the whole periphery of the cylinder-barrel section to integrally connect the cylinder-barrel section with the water jacket outer wall section, said upper block deck being located below the top of the cylinder block and so positioned that its center lies at the level of an uppermost part of the skirt section of a piston which is at a range from TDC to 30 degrees relative to TDC in crank angle;

a lower block deck located in the vicinity of the lowermost part of said cylinder-barrel section to integrally connect said cylinder-barrel section with said water jacket outer wall section; and means defining upper and lower water jackets which are located at the upper and lower sides of said upper block deck, respectively, said upper and lower water jackets forming said water jacket and communicating with each other through holes formed through said upper block deck, said lower water jacket being formed between said upper and lower block decks.

2. A cylinder block as claimed in claim 1, wherein said upper block deck is so positioned that its center lies at the level of the uppermost part of the skirt section of said piston when said piston is at TDC.

3. A cylinder block as claimed in claim 1, wherein the uppermost part of said piston skirt section is located at the border between said piston skirt section and the ring section of said piston.

4. A cylinder block as claimed in claim 1, wherein said upper water jacket is opened upward to communicate with a water jacket formed in a cylinder head which is to be secured onto the top surface of the cylinder block.

5. A cylinder block as claimed in claim 1, further comprising a lower block deck located in the vicinity of the lowermost part of said cylinder-barrel section to securely connect said cylinder-barrel section with said water jacket outer wall section, said lower water jacket being formed between said upper and lower block decks.

* * * * *